US009492864B2

(12) United States Patent
Nishikawa

(10) Patent No.: US 9,492,864 B2
(45) Date of Patent: Nov. 15, 2016

(54) MOLD APPARATUS FOR CASTING CYLINDER BLOCK

(71) Applicant: Aichi Machine Industry Co., Ltd., Nagoya-shi, Aichi (JP)

(72) Inventor: Yoshinori Nishikawa, Matsuzaka (JP)

(73) Assignee: Aichi Machine Industry, Co., Ltd., Nagoya (JP)

( * ) Notice: Subject to any disclaimer, the term of this patent is extended or adjusted under 35 U.S.C. 154(b) by 89 days.

(21) Appl. No.: 14/339,956

(22) Filed: Jul. 24, 2014

(65) Prior Publication Data

US 2015/0027654 A1 Jan. 29, 2015

(30) Foreign Application Priority Data

Jul. 26, 2013 (JP) ..... 2013-156144

(51) Int. Cl.

| | |
|---|---|
| ***B22D 19/00*** | (2006.01) |
| ***B22C 9/06*** | (2006.01) |
| ***B22D 15/02*** | (2006.01) |
| ***B22D 17/24*** | (2006.01) |
| ***B22C 9/24*** | (2006.01) |
| ***B22D 25/02*** | (2006.01) |
| *B22D 18/06* | (2006.01) |

(52) U.S. Cl.

CPC ..... *B22D 19/0009* (2013.01); *B22C 9/067* (2013.01); *B22C 9/24* (2013.01); *B22D 15/02* (2013.01); *B22D 17/24* (2013.01); *B22D 25/02* (2013.01); *B22D 18/06* (2013.01)

(58) Field of Classification Search

CPC ..... B22C 9/24; B22C 9/067; B22D 18/06; B22D 25/02; B22D 19/0009; B22D 15/02; B22D 17/24

See application file for complete search history.

(56) References Cited

FOREIGN PATENT DOCUMENTS

JP 2005324199 A * 11/2005

* cited by examiner

*Primary Examiner* — Kevin P Kerns
*Assistant Examiner* — Steven Ha
(74) *Attorney, Agent, or Firm* — Global IP Counselors, LLP

(57) ABSTRACT

A mold apparatus for casting a cylinder block having a cast-in cylinder liner by installing the cylinder liner inside a cavity and pouring a melt into the cavity, the mold apparatus includes a first mold and a bore pin. The first mold defines a deck surface of the cylinder block. The bore pin is in the first mold so as to hold the cylinder liner inside the cavity when the mold is closed. The bore pin is configured to hold the cylinder liner interposed by a gap, and the gap is arranged so as to enable gas produced during the cast-molding to be discharged therethrough.

10 Claims, 5 Drawing Sheets

MOLD APPARATUS FOR CASTING CYLINDER BLOCK

CROSS-REFERENCE TO RELATED APPLICATIONS

This application claims priority to Japanese Patent Application No. 2013-156144 filed in Japan on Jul. 26, 2011, the contents of which are hereby incorporated herein by reference.

BACKGROUND

Field of the Invention

The present invention relates to a mold apparatus for casting a cylinder block, for cast-molding a cylinder block having a cast-in cylinder liner by installing the cylinder liner inside a cavity and pouring a melt into the cavity.

Background Information

A configuration of this kind of mold apparatus for casting a cylinder block hitherto has been proposed (see, for example, Japanese Patent No. 4326395), in which a movable mold is formed by insertion-coupling a bore pin for holding a cast-in sleeve, on an inner perimeter of a water jacket-forming insert, the mold is closed in a state in which the cast-in sleeve is fitted on the bore pin, so that one end face in a longitudinal direction of the cast-in sleeve contacts with a step part on the stepped bore pin, and the mold is then filled with an aluminum melt, whereby an overcasting-type cylinder block, in which an end face on a deck-surface side on the cast-in sleeve is enclosed by the aluminum melt, is cast-molded.

In this apparatus, a surface-roughened part is formed on the insertion-coupling surface between the bore pin and the water jacket, and gas accumulating inside an elongated blocked-off cavity formed by the end face on the deck-surface side of the cast-in sleeve, a movable core, and the step part of the bore pin is discharged from the surface-roughened part. That is, the surface-roughened part is used as a gas discharge passage.

SUMMARY

Incidentally, the gas produced during casting contains carbide (release agent residue) produced by burning of an oil component in a release agent, or aluminum slag, or the like, and the carbide (release agent residue), aluminum slag, or the like, therefore adheres to the gas discharge passage when the produced gas passes through the gas discharge passage. The gas discharge passage also becomes clogged by accumulation of the carbide (release agent residue) or aluminum slag, and a periodic operation of cleaning of the gas discharge passage therefore becomes necessary. In the above-described cylinder block casting mold, in order to remove the carbide (release agent residue), aluminum slag, or the like, accumulating in the gas discharge passage, the movable mold must be disassembled, that is, the insertion-coupling between the water jacket-forming insert and the bore pin must be decupled, and the cleaning operation for removing the carbide (release agent residue), aluminum slag, or the like, becomes extensive. The casting operation must be interrupted for such cleaning operation, and therefore the operation efficiency of the casting operation also is lowered.

The present invention was created in consideration of the above, and an object thereof is to provide a technique that contributes to improvement of operation efficiency of the casting operation.

The mold apparatus for casting a cylinder block of the present invention adopts the following means in order to achieve the above-described object.

According to a preferred aspect of the mold apparatus for casting a cylinder block according to the present invention, there is configured a mold apparatus for casting a cylinder block adapted for cast-molding a cylinder block having a cast-in cylinder liner by installing the cylinder liner inside a cavity and pouring a melt into the cavity. The mold apparatus for casting a cylinder block comprises a first mold for defining a deck surface of the cylinder block; and a bore pin provided in the first mold so as to hold the cylinder liner inside the cavity when the mold is closed. The mold apparatus is configured so that the bore pin holds the cylinder liner interposed by a gap. The mold apparatus also is configured so that gas produced during the cast-molding is discharged via the gap. "Deck surface" in the present invention typically corresponds to a surface that fits with a cylinder head. "Gap" in the present invention typically corresponds to a gap produced by dimensional deviation between the bore pin and the cylinder liner, but ideally includes a gap produced between an uneven surface from surface roughness of the bore pin and an uneven surface from surface roughness of the cylinder liner, or a gap actively provided between the bore pin and the cylinder liner.

According to the present invention, the configuration utilizes a cylinder liner that is exchanged each time a cylinder block is cast-molded, as a constituent element of the gas discharge path for discharging gas produced during cast-molding. The accumulation of carbide (release agent residue), or the like, in the gas discharge path therefore can be effectively prevented. The frequency of the operation of cleaning of the gas discharge path thereby can be reduced, and the time required for planning or the casting preparation operation can be shortened. That is, the casting cycle can be shortened. The operation efficiency of the casting operation can be improved as a result. Even if carbide (release agent residue), or the like, adheres to the side of the bore pin, being one constituent element of the gas discharge path, the carbide (release agent residue), or the like, can be easily removed using a brush, or the like, in a state in which the bore pin is placed in the first mold, and therefore the burden on the operator associated with the cleaning operation also can be alleviated.

According to another aspect of the mold apparatus for casting a cylinder block according to the present invention, the mold apparatus further comprises a water jacket-forming insert surrounding the cylinder liner held by the bore pin when the mold is closed. The mold apparatus also is configured so that the gas that has entered into a space inside the cavity is discharged via the gap, the space being formed by the cylinder liner held by the bore pin and by the water jacket-forming insert.

According to the present aspect, gas accumulating in an elongated blocked-off space formed by the cylinder liner and the water jacket-forming insert can be discharged. Formation of a blowhole or the like, in the part corresponding to the elongated blocked-off space in the cylinder block can thereby be effectively prevented. The close adhesiveness of the cylinder liner to the part corresponding to the elongated blocked-off space in the cylinder block also can be improved. The quality of the cylinder block as a manufactured product can be improved as a result.

According to another aspect of the mold apparatus for casting a cylinder block according to the present invention, the bore pin has a shaft part with which the cylinder liner is fitted, and an enlarged-diameter part formed to a larger diameter than the shaft part. The enlarged-diameter part is provided closer to the side of the first mold than to the shaft part. The mold apparatus also is configured so that the cylinder liner is held by the bore pin in a state in which longitudinal-direction movement of the cylinder liner is restricted by the enlarged-diameter part when the mold is closed, and is configured so that the gas that has entered into a space inside the cavity is discharged via the gap provided between the bore pin and the cylinder liner, the space being formed by a longitudinal-direction end face of the cylinder liner, the enlarged-diameter part, and the water jacket-forming insert.

According to the present aspect, when cast-molding an overcasting-type cylinder block in which the face in the longitudinal direction of the cylinder liner, that is, the end face on the deck surface side is enclosed by melting, gas accumulating in the elongated blocked-off space formed by the longitudinal-direction end face of the cylinder liner, the enlarged-diameter part, and the first mold can be discharged. Formation of a blowhole or the like, in the part corresponding to the elongated blocked-off space in the cylinder block can thereby be effectively prevented. The close adhesiveness of the cylinder liner to the part corresponding to the elongated blocked-off space in the cylinder block also can be improved. The quality of the overcasting-type cylinder block as a manufactured product can be improved as a result.

According to another aspect of the mold apparatus for casting a cylinder block according to the present invention, the gap is configured to enable inflow of the gas but prohibit inflow of the melt.

According to the present aspect, gas produced during cast-molding can be discharged effectively. The operation efficiency of the casting operation can be improved as a result.

According to another aspect of the mold apparatus for casting a cylinder block according to the present invention, the bore pin has a recessed part formed on an outer perimeter surface, and a communicating path communicating between the recessed part and the outside of the mold apparatus for casting a cylinder block. "Connecting between the recessed part and the outside of the mold apparatus for casting a cylinder block" in the present invention ideally includes a mode in which the communicating path directly communicates between the recessed part and the outside, as well as a mode in which the communicating path communicates between the recessed part and the outside via another communicating path.

According to the present aspect, gas passing through the gap between the bore pin and the cylinder liner can be discharged to the outside using a communicating path communicating between the recessed part formed on the outer perimeter surface of the bore pin and the outside of the mold apparatus for casting a cylinder block.

According to another aspect of the mold apparatus for casting a cylinder block according to the present invention, the recessed part is configured as an annular groove continuing in a circumferential direction.

According to the present aspect, because the recessed part is configured as an annular groove, a recessed part having a large capacity can be assured with a simple configuration. The flow speed of the gas passing through the gap between the bore pin and the cylinder liner thereby can be reduced in the annular groove, and the gas can be effectively discharged from the communicating path to the outside via the annular groove. The operation efficiency in the casting operation can be improved as a result.

According to another aspect of the mold apparatus for casting a cylinder block according to the present invention, the communicating path has a first hole opened in a direction from the recessed part toward the inside of the shaft part, and a second hole opened in a direction from the first hole toward the first mold. "Direction toward the inside of the shaft part" in the present invention typically corresponds to a direction perpendicular to the longitudinal direction of the shaft part, but ideally includes a direction inclined toward the longitudinal direction of the shaft part. "Direction from the first hole toward the first mold" also typically corresponds to a direction following the longitudinal direction of the shaft part, but ideally includes a direction inclined toward the longitudinal direction of the shaft part.

According to the present invention, because the configuration is such that the route for discharging gas passing through the gap between the bore pin and the cylinder liner to the outside is formed inside the bore pin, complication of the route for discharging the gas to the outside can be prevented. Because only opening a hole is sufficient, the route for discharging the gas to the outside can be configured simply.

According to another aspect of the mold apparatus for casting a cylinder block according to the present invention, the recessed part has an axial groove connected to the annular groove and provided extending in a longitudinal-axis direction of the bore pin from the annular groove toward a leading end side of the bore pin. The first hole is formed on the leading end side of the axial groove.

According to the present aspect, the position of the formation of the annular groove on the bore pin and the position of formation of the first hole in the bore pin can be provided in a state being separated in the axial direction. That is, the annular groove can be provided near the end part of the bore pin which is connected to the first mold. In other words, the annular groove can be provided on the part of the bore pin near the deck surface side of the cylinder liner where gas easily accumulates. On the other hand, the first hole can be provided near the leading end side of the bore pin on the opposite side of the first mold so that clogging of the hole is easily confirmed by eye. The gas discharge performance and visibility of the gas discharge path can be achieved simultaneously.

According to another aspect of the mold apparatus for casting a cylinder block according to the present invention, the mold apparatus further comprises a vacuum suction device for rendering the inside of the cavity into a vacuum state. The mold apparatus also is configured so that the communicating path communicates between the recessed part and the vacuum suction device.

According to the present aspect, because the configuration is such that the communicating path communicates between the recessed part and the vacuum suction device, the gas can be discharged effectively. The operation efficiency in the casting operation can be improved as a result.

According to the present invention, the operation efficiency of the casting operation can be improved.

BRIEF DESCRIPTION OF THE DRAWINGS

Referring now to the attached drawings which form a part of this original disclosure.

DETAILED DESCRIPTION OF EMBODIMENTS

Preferred embodiments of the present invention are next described using examples.

Examples

Figure 1:
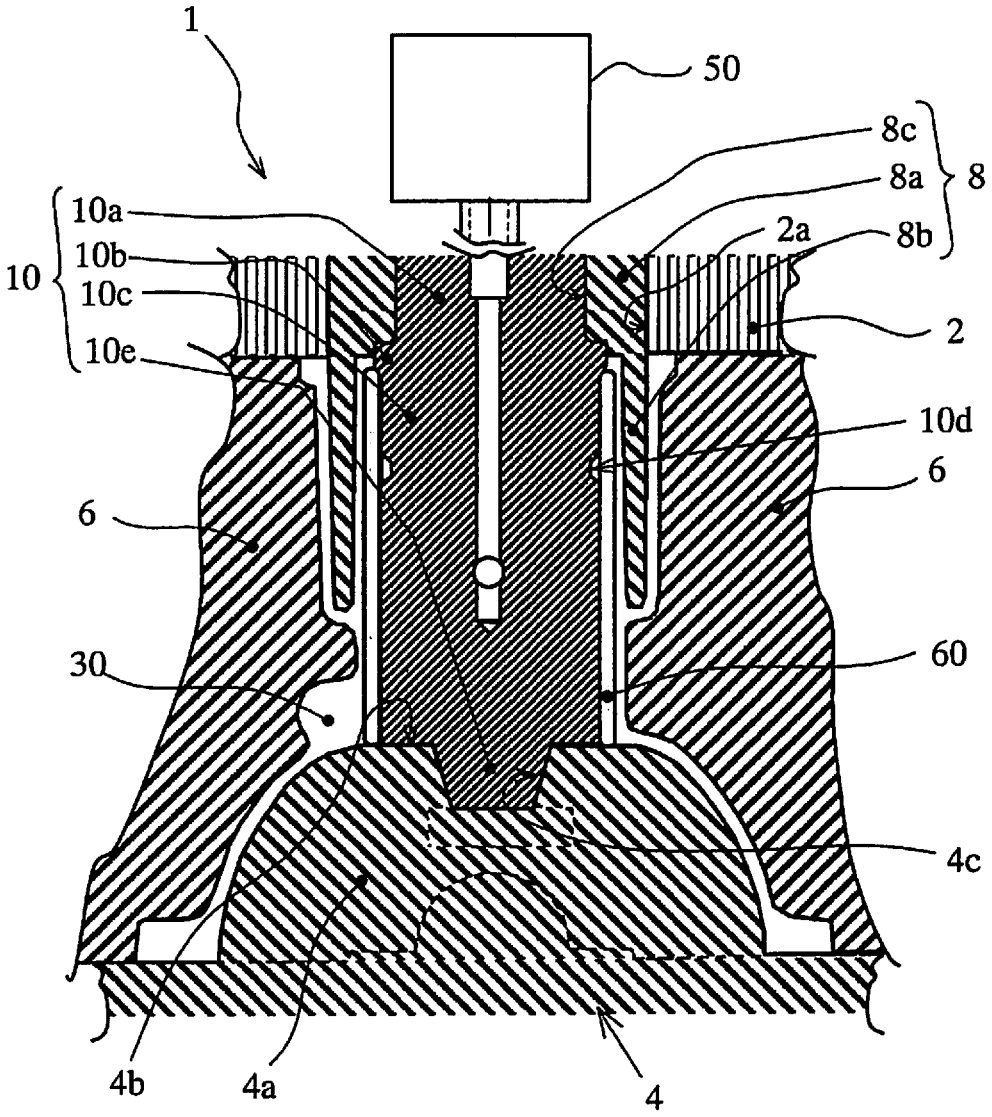
FIG. 1 is a configuration diagram schematically illustrating the configuration of the mold apparatus according to an embodiment of the present invention.
Figure 2:
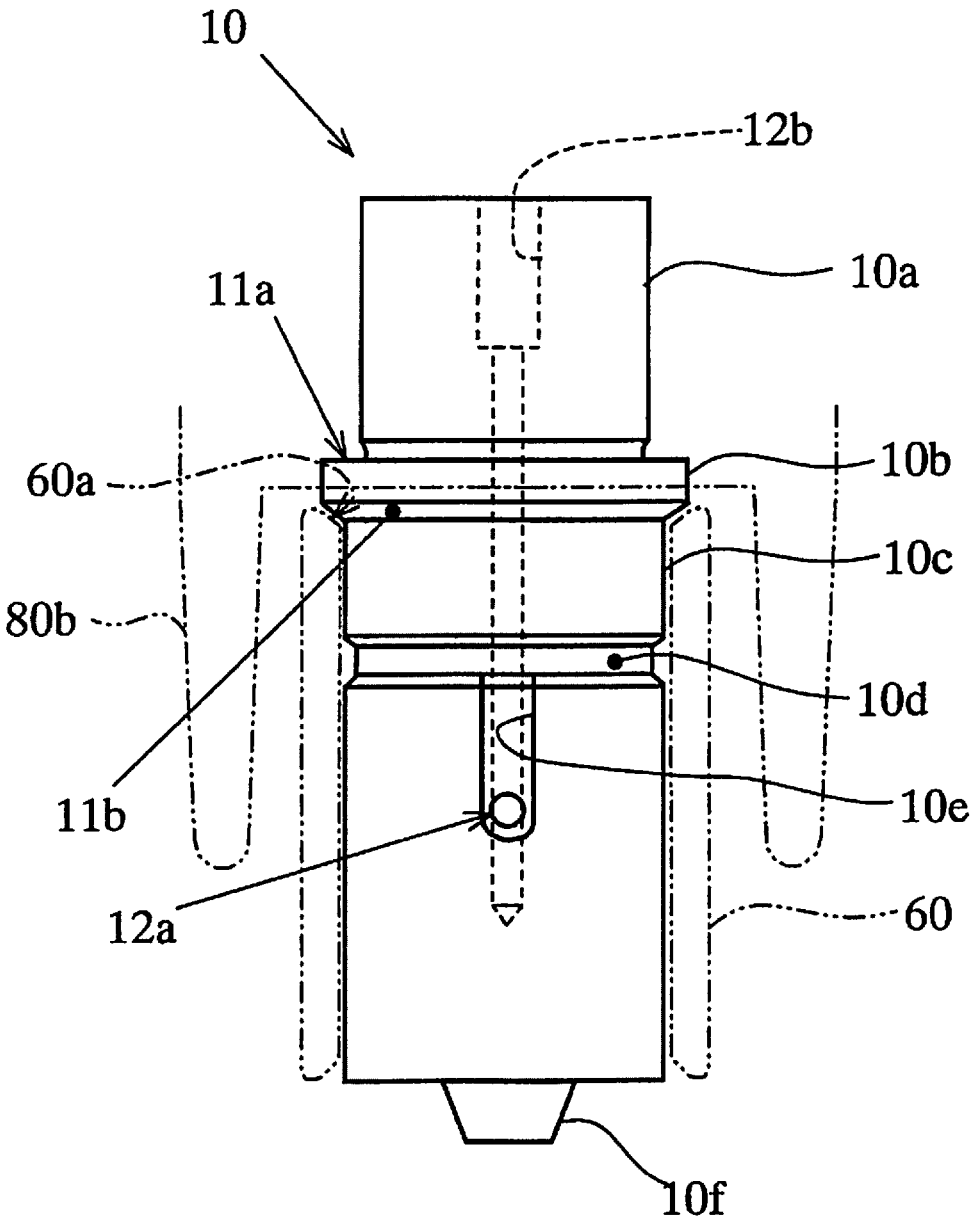
FIG. 2 is an external view illustrating the general appearance of the bore pin.
Figure 3:
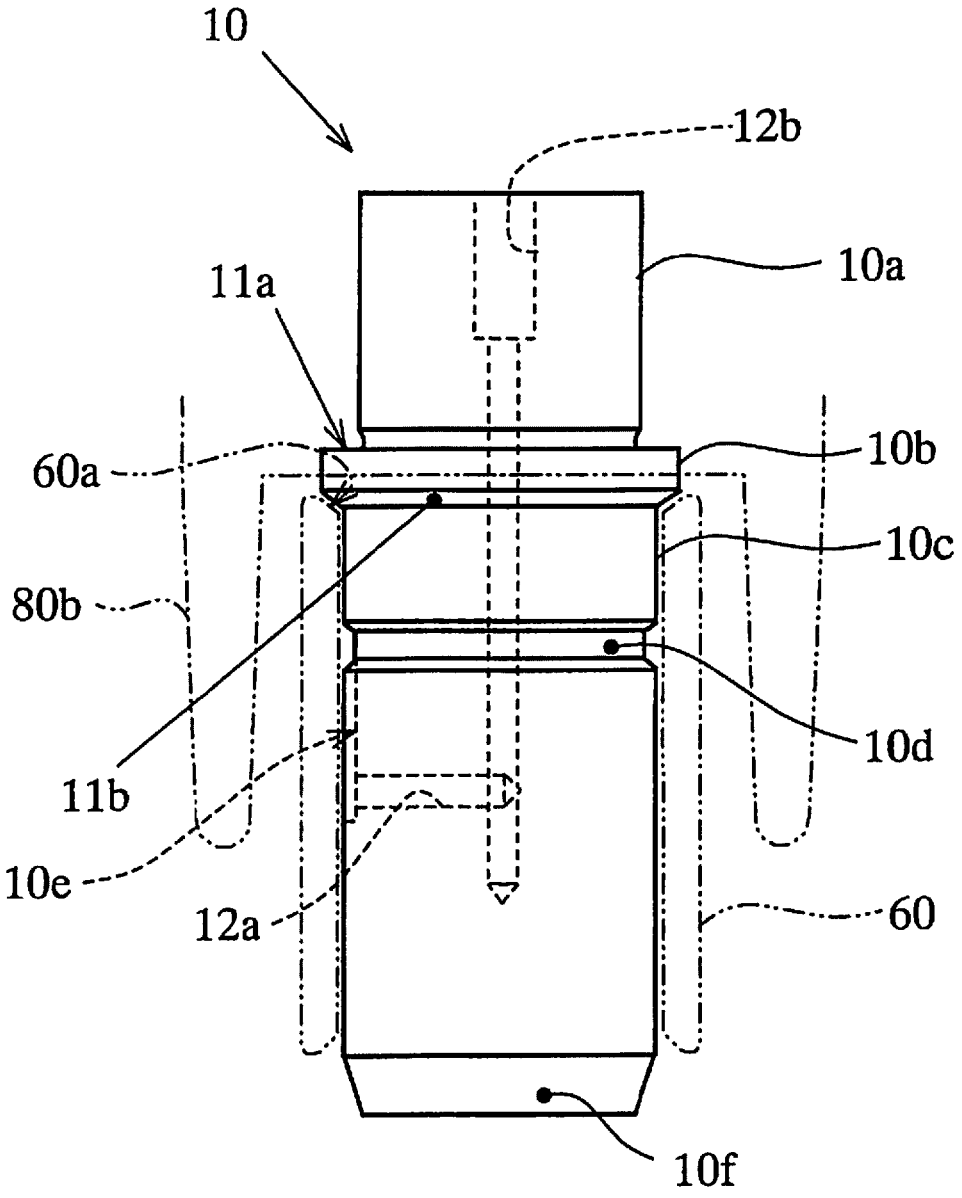
FIG. 3 is an external view illustrating the general appearance of the bore pin.
Figure 4:
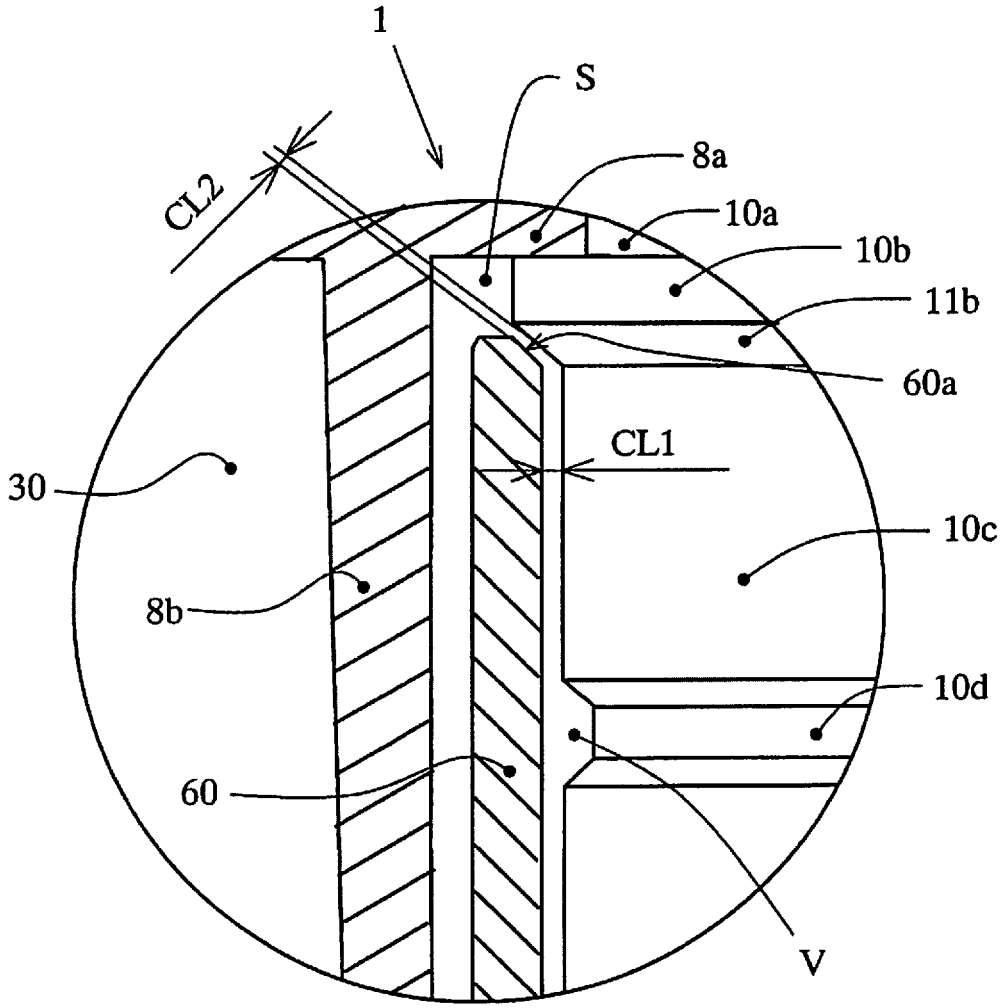
FIG. 4 is an enlarged sectional view illustrating in enlargement the state of the bore pin and the cylinder liner when the mold is closed.

FIG. 1 is a configuration diagram schematically illustrating the configuration of the mold apparatus 1, FIGS. 2 and 3 are external views illustrating the general appearance of the bore pin, and FIG. 4 is an enlarged sectional view illustrating in enlargement the state of the bore pin 10 and the cylinder liner 60 when the mold is closed. The mold apparatus 1 according to the present embodiment is provided with a movable mold 2, a fixed mold 4, a movable core 6, a water jacket-forming insert 8 fixed to the movable mold 2, and a bore pin 10 fixed to the water jacket-forming insert 8, as illustrated in FIG. 1. A vacuum suction device 50 is connected to the mold apparatus 1. The mold apparatus 1 and the vacuum suction device 50 correspond to the "mold apparatus for casting a cylinder block" in the present invention, and the movable mold 2 corresponds to the "first mold" in the present invention, as one example of a working configuration. The water jacket-forming insert 8 corresponds to the "water jacket-forming insert" in the present invention, and the bore pin 10 corresponds to the "bore pin" in the present invention, as one example of a working configuration. The vacuum suction device 50 corresponds to the "vacuum suction device" in the present invention as on example of a working configuration.

The movable mold 2 is a main part configuring the main unit of the mold apparatus 1 as illustrated in FIG. 1. The movable mold 2 is configured to define in particular an upper deck surface inside a cavity 30 configuring the shape of the cylinder block as a manufactured product. An installation hole 2*a* for insertion-coupling the water jacket-molding insert 8, to be described later, is formed in the movable mold 2. An extrusion mechanism not illustrated is provided on the movable mold 2 in order to remove the cylinder block as a cast-molded manufactured product.

The fixed mold 4 is a main part configuring the main unit of the mold apparatus 1 and configures the cavity 30 just as the movable mold 2, as illustrated in FIG. 1. The fixed mold 4 is provided with a bulging part 4*a* for forming a crankcase. A flat surface 4*b* being flat is formed on a top part of the bulging part 4*a*, and a recessed part 4*c* being trapezoidal in section is formed in a center part of the flat surface 4*b*. Here, although not illustrated, the recessed part 4*c* is configured as a groove following the direction of a cylinder array (the direction of planes of paper in FIG. 1) on a cylinder block as a manufactured product. An inlet bush not illustrated is provided on the fixed mold 4 in order to inject a melt.

The movable core 6 is a main part configuring the main unit of the mold apparatus 1 and configures the cavity 30 just as the movable mold 2 and the fixed mold 4, as illustrated in FIG. 1. The movable core 6 forms an undercut part on the cylinder block as a manufactured product.

The water jacket-forming insert 8 is configured from the installation part 8*a* and the water jacket-forming part 8*b* as illustrated in FIG. 1. The installation part 8*a* is configured in a cylindrical shape having a hole 8*c* formed in the center, and has an outer diameter roughly the same diameter as an inner diameter of the movable mold 2. The water jacket-forming insert 8 is integrally connected to the movable mold 2 by insertion-coupling of the installation part 8*a* in the installation hole 2*a* of the movable mold 2. In the example, the water jacket-forming insert 8 is configured as being integrally connected to the movable mold 2 after being formed separately from the movable mold 2, but the water jacket-forming insert 8 may be configured being integrally molded on the movable mold 2. In this case, the water jacket-forming insert 8 corresponds to the "first mold" in the present invention as one example of a working configuration.

The water jacket-forming part 8*b* is a part forming a water jacket on the cylinder block as a manufactured product, and is configured in a roughly cylindrical shape, as illustrated in FIG. 1. An outer diameter of the water jacket-forming part 8*b* is formed to roughly the same diameter as the outer diameter of the installation part 8*a*, and an inner diameter of the water jacket-forming part 8*b* is configured to be larger than an outer diameter of the cylinder liner 60 cast in the cylinder block as a manufactured product. That is, the water jacket-forming part 8*b* is configured to surround the cylinder liner 60 held by the bore pin 10, to be described later, whereby a space (one part of the cavity 30) is configured between an inner perimeter surface of the water jacket-forming part 8*b* and an outer perimeter surface of the cylinder liner 60, and the cylinder liner 60 is cast in by the melt by flowing of the melt into the space (one part of the cavity 30). The water jacket-forming insert 8 projects into the cavity 30 and configures a core when the mold is closed. The water jacket-forming part 8*b* surrounding the cylinder liner held by the bore pin 10 corresponds to the "water jacket-forming insert surrounding the cylinder liner held by the bore pin" in the present invention as one example of a working configuration.

The bore pin 10 is configured with an installation part 10*a* fitted into the hole 8*c* of the water jacket-forming insert 8, a flange-form enlarged-diameter part 10*b* formed continuing on the installation part 10*a*, and a holding part 10*c* for holding the cylinder liner 60, as illustrated in FIGS. 2 and 3.

The installation part 10*a* is configured in a cylindrical shape, and has an outer diameter roughly the same diameter as an inner diameter of the hole 8*c* of the water jacket-forming insert 8, as illustrated in FIGS. 2 and 3. The bore pin 10 is integrally connected to the water jacket-forming insert 8 by insertion-coupling of the installation part 10*a* in the hole 8*c*. In the example, the bore pin 10 is configured as being integrally connected to the water jacket-forming insert 8 after being formed separately from the water jacket-forming insert 8, but the bore pin 10 may be configured being integrally molded on the water jacket-forming insert 8.

The enlarged-diameter part 10*b* is formed to a larger diameter than the installation part 10*a* and the holding part 10*c*, as illustrated in FIGS. 2 and 3. An end face 11*a* on the side of the installation part 10*a*, among end faces of a radially-extended extended part of the enlarged-diameter part 10*b*, contacts with the installation part 8*a* of the water jacket-forming insert 8. The bore pin 10 is thereby positioned in an axial direction against the water jacket-forming insert 8. An end face 11*b* on the side opposite the end face 11*a*, that is, on the side of the holding part 10*c*, among the end faces of the radially-extended extended part of the enlarged diameter part 10*b*, restricts movement in a longitudinal-axis direction of the cylinder liner 60 when the mold is closed. The enlarged-diameter part 10*b* corresponds to the "enlarged-diameter part" in the present invention as one example of a working configuration.

The holding part 10*c* is configured to a long cylindrical shape extending in a longitudinal direction, as illustrated in FIGS. 2 and 3. The holding part 10*c* has an outer diameter such that a prescribed gap CL1 is formed between the inner perimeter surface 10*c* of the holding part 10*c* and the inner perimeter surface of the cylinder liner 60 when the mold is closed 60, and has a long axis such that a prescribed gap CL2 is formed between the end face 11*b* of the enlarged-diameter part 10*b* and the end face 60*a* in the longitudinal-axis direction of the cylinder liner 60 when the mold is closed, as illustrated in FIG. 4. The holding part 10*c* corresponds to the "shaft part" in the present invention, and the end face 60*a* in the longitudinal-axis direction of the cylinder liner 60 corresponds to the "longitudinal-direction end face of the cylinder liner" in the present invention, as one example of a working configuration.

That is, the holding part 10*c* is set to a fitting tolerance such that the prescribed gap CL1 is provided between the outer perimeter surface of the holding part 10*c* and the inner perimeter surface of the cylinder liner 60, even with consideration of the outer diameter tolerance of the holding part 10*c* and the inner diameter tolerance of the cylinder liner 60, and is set to a tolerance relationship such that the prescribed gap CL2 is provided between the end face 11 of the enlarged-diameter part 10*b* and the end face 60*a* in the longitudinal-axis direction of the cylinder liner 60 when the mold is closed, even with consideration of the axial length tolerance of the holding part 10*c* and the axial length tolerance of the cylinder liner 60. The tolerance is set to a value such that the aluminum melt does not intrude into the prescribed gaps CL1 and CL2 even when the prescribed gaps CL1 and CL2 fluctuate in a direction to become maximal. Therefore, the gap CL1 and the gap CL2 are configured to enable inflow of the gas produced during cast-molding but prohibit inflow of the aluminum melt. A median value of the tolerance for the prescribed gaps CL1 and CL2 is preferably set such that the prescribed gaps CL1 and CL2 become maximal within a limit that the aluminum melt does not intrude. The prescribed gaps CL1 and CL2 correspond to the "gap" in the present invention as one example of a working configuration. The mode setting to fitting tolerance such that the prescribed gaps CL1 and CL2 become maximal within a range of the gap through which the aluminum melt does not intrude corresponds to being "set to a maximum gap allowing inflow of the gas but disallowing inflow of the melt" in the present invention as one example of a working configuration.

An annular groove 10*d* is formed on the holding part 10*c* in a position further toward the installation part 10*a* (upward in FIGS. 2 and 3) from the center in the longitudinal direction, as illustrated in FIGS. 2 and 3. By thus forming the annular groove 10*d* further toward the installation part 10*a*, gas accumulating in an elongated blocked-off space S to be described later (one part of the cavity 30, being a space formed by the end face 60*a* in the longitudinal-axis direction of the cylinder liner 60, the enlarged-diameter part 10*b* of the bore pin 10, and the end face of the installation part 8*a* of the water jacket-forming insert 8 when the mold is closed) can be effectively discharged. The annular groove 10*d* corresponds to the "recessed part" and the "annular groove" in the present invention as one example of a working configuration.

A long groove 10*e* having one end connected to the annular groove 10*d* and having the other end placed extending with a prescribed length in the longitudinal direction toward the leading end side of the bore pin 10 also is formed on the holding part 10*c*. A hole 12*a* in a direction going toward the inside of the holding part 10*c* is formed on the leading end part (the part on the side opposite the annular groove 10*d*) of the long groove 10*e*. That is, the hole 12*a* is opened in a direction perpendicular to the longitudinal direction of the holding part 10*c*. The long groove 10*e* is formed to a length to an extent that the hole 12*a* is visible from the outside even in a state in which the bore pin 10 is installed in the water jacket-forming insert 8. By thus providing the long groove 10*e*, the annular groove 10*d* can be placed in a position having considered gas discharge performance, that is, in a upper portion of the bore pin 10 (upward in FIGS. 1 to 3), while the hole 12*a* can be placed in a position where absence of clogging can be confirmed by the operator's observation, that is, in a lower portion of the bore pin 10 (downward in FIGS. 1 to 3). Gas discharge performance and visibility of the gas discharge path thereby can be achieved simultaneously. The long groove 10*e* corresponds to the "axial groove" in the present invention as one example of a working configuration.

A through-hole 12*b* having one end open to the hole 12*a* and having the other end open to an end face on the installation part 10*a* furthermore is formed on the holding part 10*c* as illustrated in FIGS. 2 and 3. That is, the through-hole 12*b* is formed in a direction following the longitudinal direction inside the holding part 10*c*. The through-hole 12*b* also is connected to the vacuum suction device 50 via piping not illustrated. A protruding part 10*f* trapezoidal in section is formed in a protruding form on the leading end of the holding part 10*c*. Although not illustrated, the protruding part 10*f* is formed as an elongated protrusion following the direction of a cylinder array on a cylinder block as a manufactured product, and insertion-couples with the recessed part 4*c* of the fixed mold 4 when the mold is closed. The hole 12*a* corresponds to the "first hole" in the present invention, and the through-hole 12*b* corresponds to the "second hole" in the present invention, as one example of a working configuration. The hole 12*a* and the through-hole 12*b* also correspond to the "communicating path" in the present invention as one example of a working configuration.

Figure 5:
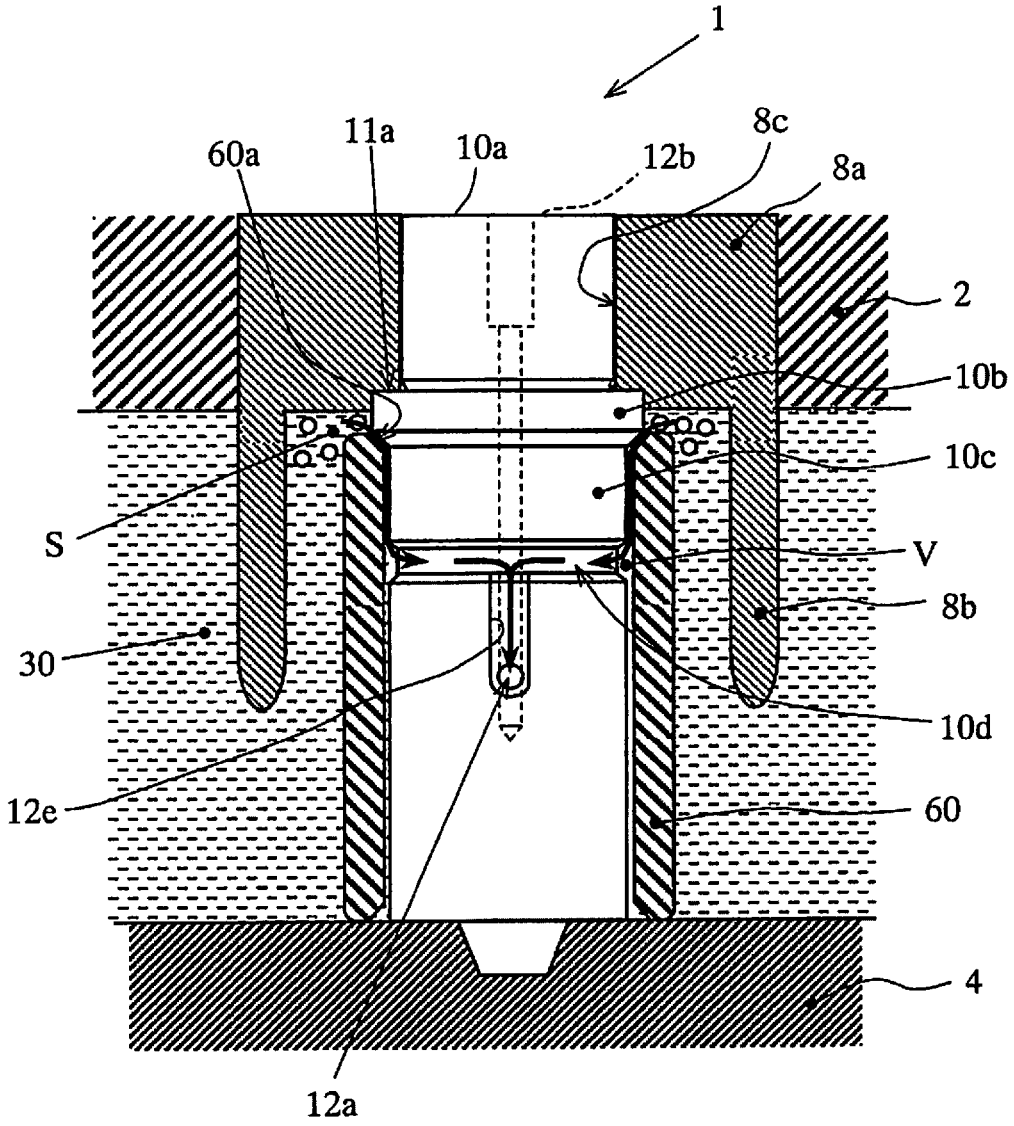
FIG. 5 is an explanatory diagram illustrating the manner of cast-molding using the mold apparatus according to an embodiment of the present invention.

The operation of the mold apparatus 1 in the example thus configured, in particular the operation when an aluminum melt is poured into the cavity 30, is next described. FIG. 5 is an explanatory diagram illustrating the manner of cast-molding using the mold apparatus 1 according to an embodiment of the present invention. In cast-molding a cylinder block, first the mold is closed. Closing of the movable mold 2 is performed in a state in which the cylinder liner 60 made of iron is held by the bore pin 10 integrally installed in the movable mold 2 via the water jacket-forming insert 8. When the mold is closed, movement of the cylinder liner 60 in the longitudinal direction is restricted by the enlarged-diameter part 10*b* of the bore pin 10 and the fixed mold 4. In the state in which the mold is closed, a prescribed gap CL1 is formed between the inner perimeter surface of the cylinder liner 60 and the outer perimeter surface of the holding part 10*c* on the bore pin 10, and a prescribed gap CL2 is formed between the end face 60*a* in the longitudinal-axis direction of the cylinder liner 60 and the end face 11*b* of the enlarged-diameter part 10*b*. A volume part V also is formed by the inner perimeter surface of the cylinder liner 60 and the annular groove 10*d* formed on the holding part 10*c*. A cavity 30 configuring a shape of a cylinder block as a manufactured product is defined by closing of the mold in this manner.

At this time, an elongated blocked-off space S (one part of the cavity 30) is formed by the cylinder liner 60, the enlarged-diameter part 10*b* of the bore pin 10, the water jacket-forming insert 8, in particular the end face 60*a* in the longitudinal-axis direction of the cylinder liner 60, the enlarged-diameter part 10*b* of the bore pin 10, and the end face of the installation part 8*a* of the water jacket-forming insert 8. The elongated blocked-off space S formed by the end face 60*a* in the longitudinal-axis direction of the cylinder liner 60, the enlarged-diameter part 10*b* of the bore pin 10, and the end face of the installation part 8*a* of the water jacket-forming insert 8 corresponds to the "space formed by an longitudinal-direction end face of the cylinder liner, the enlarged-diameter part, and the first mold" as one example of a working configuration.

An aluminum melt is poured into the cavity 30 after the mold is closed in this manner. Here, the major part of the gas produced inside the cavity 30 during cast-molding is discharged by a gas-venting device (gas-venting valve, gas vent, or the like) not illustrated provided on the mold apparatus 1. Meanwhile, in the cavity 30, gas driven into the above-described elongated blocked-off space S flows into the prescribed gap CL2 formed between the end face 60*a* in the longitudinal-axis direction of the cylinder liner 60 and the end face 11*b* of the enlarged-diameter part 10*b*, and into the prescribed gap CL1 formed between the inner perimeter surface of the cylinder liner 60 and the outer perimeter surface of the bore pin 10. The flow speed of the gas flowing through the prescribed gaps CL1 and CL2 is lowered by the volume part V. The gas flowing into the volume part V is thereby effectively suctioned by the vacuum suction device 50 via the hole 12*a* and the through-hole 12*b*. Because the annular groove 10*d* is provided in the upper portion of the holding part 10*c* closer to the space S, the gas driven into the elongated blocked-off space S can be effectively discharged.

Because the gas driven into the cul-de-sac form space S thus can be discharged favorably, inconveniences during cast-molding of overcasting-type cylinder blocks, specifically, production of a blowhole, or the like, by gas accumulating in the space S, or defects of poor closeness of adhesion of the cylinder liner to the aluminum melt, more specifically, to a cylinder block configured from aluminum, can be effectively prevented. The quality of the overcasting-type cylinder block as a manufactured can be improved as a result.

Here, carbide (release agent residue), aluminum slag, or the like, adheres to the gaps CL1 and CL2 when the gas inside the cavity 30 passes through the gaps CL1 and CL2, but because the configuration is such that the cylinder liner 60 being one constituent element of the gaps CL1 and CL2 is replaced each time a cylinder block is cast-molded, the carbide (release agent residue), aluminum slag, or the like, is removed by the cylinder liner 60 each time the mold is opened, and accumulation of residue in the gaps CL1 and CL2 can be effectively prevented. The frequency of the operation of cleaning the gaps CL1 and CL2 as gas discharge paths thereby can be reduced, and the casting cycle can be shortened. The operation efficiency of the casting operation thereby can be improved. Even if carbide (release agent residue), aluminum slag, or the like, adheres to the side of the bore pin 10, being one constituent element of the gaps CL1 and CL2, the carbide (release agent residue), aluminum slag, or the like, can be easily removed using a brush, or the like, in a state in which the bore pin 10 is installed in the movable mold 2, and the burden on the operator associated with the cleaning operation can be alleviated.

Although the gaps CL1 and CL2 allow inflow of gas, the gaps are set to a size that prevents inflow of aluminum melt, and therefore there is no entry of aluminum melt into the gaps CL1 and CL2. Furthermore, effective gas discharge performance can be realized by setting a median value of the tolerance for the gaps CL1 and CL2 such that the gaps CL1 and CL2 become maximal within a range of the gap through which the aluminum melt does not get inside. Because the hole 12*a* is visible by the eye when the mold is opened, clogging of the hole 12*a* can be confirmed.

According to the mold apparatus 1 according to the present embodiment described above, the apparatus is configured so that prescribed gaps CL2 and CL1 are formed between the end face 60*a* in the longitudinal-axis direction of the cylinder liner 60 made of iron and the end face 11*b* of the enlarged-diameter part 10*b* on the bore pin 10, and between the inner perimeter surface of the cylinder liner 60 and the outer perimeter surface of the holding part 10*c* on the bore pin 10. The configuration is such that gas driven into an elongated blocked-off space S (one part of the cavity 30) formed by the end face 60*a* in the longitudinal-axis direction of the cylinder liner 60, the enlarged-diameter part 10*b* of the bore pin 10, and the end face of the installation part 8*a* of the water jacket-forming insert 8 is discharged via the gaps CL1 and CL2. That is, the configuration is such that the gaps CL1 and CL2 as gas discharge paths are formed by the cylinder liner 60, which is replaced each time a cylinder block is cast-molded. Therefore, even if carbide (release agent residue), aluminum slag, or the like, adheres to the gaps CL1 and CL2 when the gas passes through the gaps CL1 and CL2, the carbide (release agent residue), aluminum slag, or the like, can be removed by the cylinder liner 60 each time the mold is opened. The accumulation of carbide (release agent residue), aluminum slag, or the like, in the gaps CL1 and CL2 thereby can be effectively prevented. Accordingly, the frequency of the operation of cleaning of the gaps CL1 and CL2 as gas discharge paths can be reduced, and the time for planning or the casting preparation operation can be shortened. That is, the casting cycle can be shortened. The operation efficiency of the casting operation can be improved as a result. Even if carbide (release agent residue), aluminum slag, or the like, adheres to the side of the bore pin 10, being one constituent element of the gaps CL1 and CL2, the carbide (release agent residue), aluminum slag, or the like, can be easily removed using a brush, or the like, in a state in which the bore pin 10 is installed in the movable mold 2, and therefore the burden on the operator associated with the cleaning operation also can be alleviated.

Also according to the mold apparatus 1 according to the present embodiment, although the gaps CL1 and CL2 allow inflow of gas, the gaps are set to a size that prevents the inflow of melt, and therefore there is no entry of aluminum melt into the gaps CL1 and CL2. Furthermore, effective gas discharge performance can be realized by setting a median value of the tolerance for the gaps CL1 and CL2 such that the gaps CL1 and CL2 become maximal within a range of the gap through which the aluminum melt does not get inside. The operation efficiency in the casting operation thereby can be improved.

Also according to the mold apparatus 1 according to the present embodiment, because the configuration is such that the volume part V formed by the inner perimeter surface of the cylinder liner 60 and the annular groove 10*d* is provided at midcourse of the route for discharging gas flowing through the gaps CL1 and CL2 to the outside, the flow speed of the gas flowing in from the gaps CL1 and CL2 can be reduced by the volume part V. The gas flowing into the volume part V thereby can be effectively suctioned by the vacuum suction device 50.

Also according to the mold apparatus 1 according to the present embodiment, because the configuration is such that the annular groove 10*d* is provided above the holding part 10*c* on the bore pin 10 and the hole 12*a* is provided below the holding part 10*c* using the long groove 10*e*, the gas discharge performance and visibility for confirming clogging of the hole 12*a* can be achieved simultaneously.

Also according to the mold apparatus 1 according to the present embodiment, because the configuration is such that the route for discharging the gas flowing through the hole 12*a* and the through-hole 12*b*, that is, through the gaps CL1 and CL2 to the outside is formed inside the bore pin 10, complication of the route for discharging the gas to the outside can be prevented. Because only opening a hole is sufficient, the route for discharging the gas to the outside can be assured simply.

In the mold apparatus 1 in the example, the configuration is such that the annular groove 10*d* is formed on the holding part 10*c* on the bore pin 10, but anything is possible provided that a route for discharging gas flowing through the gaps CL1 and CL2 to the outside can be formed. For example, the configuration may be such that a simple recessed part is formed.

In the mold apparatus 1 in the example, a case applied to cast-molding of an overcasting-type cylinder block is described, but the invention is applicable to cast-molding of cylinder blocks other than of overcasting type. In this case, the configuration should be such that the bore pin 10 does not have an enlarged-diameter part 10*b*, and the configuration should be such that the prescribed gap CL2 is formed between the end face 60*a* in the longitudinal-axis direction of the cylinder liner 60 and the installation part 8*a* on the water jacket-forming insert 8. In this case as well, there is provided the same effect as of the mold apparatus 1 according to the present embodiment described above, that is, the same effect that even if carbide (release agent residue), aluminum slag, or the like, adheres to the gaps CL1 and CL2 when the gas passes through the gaps CL1 and CL2, the carbide (release agent residue), aluminum slag, or the like, is removed by the cylinder liner 60 each time the mold is opened, whereby accumulation of carbide (release agent residue), aluminum slag, or the like, in the gaps CL1 and CL2 can be effectively prevented.

In the mold apparatus 1 in the example, the configuration is such that the long groove 10*e* is provided, but the long groove 10*e* also may be absent. In this case, the configuration should be such that the hole 12*a* is opened in the annular groove 10*d*.

In the mold apparatus 1 in the example, the configuration is such that the hole 12*a* opens in a direction perpendicular to the longitudinal direction of the holding part 10*c*, but the configuration may be such that the hole 12*a* is opened being inclined toward the longitudinal direction of the holding part 10*c*.

In the mold apparatus 1 in the example, the configuration is such that the through-hole 12*b* is formed in a direction following the longitudinal direction of the holding part 10*c*, but the configuration may be such that the through-hole 12*b* is formed being inclined toward the longitudinal direction of the holding part 10*c*.

In the mold apparatus 1 in the example, the configuration is such that the annular groove 10*d* is connected to the vacuum suction device 50 via two holes being the hole 12*a* and the through-hole 12*b*, but the configuration may be such that the annular groove 10*d* and the vacuum suction device 50 are connected by one hole.

Correspondences Between Each Constituent Element of the Embodiment and Each Constituent Element of the Present Invention The present embodiment illustrates one example of an embodiment of the present invention. Accordingly, the present invention is not limited to the configuration of the present embodiment. Correspondences between each constituent element of the present embodiment and each constituent of the present invention are listed below.

The mold apparatus 1 corresponds to the "mold apparatus for casing a cylinder block" of the present invention as one example of a configuration.

The vacuum suction device 50 corresponds to the "mold apparatus for casting a cylinder block" of the present invention as one example of a configuration.

The movable mold 2 corresponds to the "first mold" of the present invention as one example of a configuration.

The bore pin 10 corresponds to the "bore pin" of the present invention as one example of a configuration.

The vacuum suction device 50 corresponds to the "vacuum suction device" of the present invention as one example of a configuration.

The water jacket-forming insert 8 corresponds to the "water jacket-forming insert" of the present invention as one example of a configuration.

The enlarged-diameter part 10*b* corresponds to the "enlarged-diameter part" of the present invention as one example of a configuration.

The holding part 10*c* corresponds to the "shaft part" of the present invention as one example of a configuration.

The end face 60*a* in the longitudinal-axis direction of the cylinder liner 60 corresponds to the "end face in a longitudinal direction of the cylinder liner" of the present invention as one example of a configuration.

The prescribed gaps CL1 and CL2 correspond to the "gap" of the present invention as one example of a configuration.

The annular groove 10*d* corresponds to the "recessed part" of the present invention as one example of a configuration.

The annular groove 10*d* corresponds to the "annular groove" of the present invention as one example of a configuration.

The long groove 10*e* corresponds to the "recessed part" of the present invention as one example of a configuration.

The long groove 10*e* corresponds to the "axial groove" of the present invention as one example of a configuration.

The hole 12*a* corresponds to the "first hole" of the present invention as one example of a configuration.

The hole 12*a* corresponds to the "communicating path" of the present invention as one example of a configuration.

The through-hole 12*b* corresponds to the "second hole" of the present invention as one example of a configuration.

The through-hole 12*b* corresponds to the "communicating path" of the present invention as one example of a configuration.

The space S corresponds to the "space formed by a longitudinal-direction end face of the cylinder liner, the enlarged-diameter part, and the first mold" of the present invention as one example of a configuration.

In view of the gist of the invention above, a mold apparatus according to the present invention can be configured with the following modes.

(Mode 1)

"A mold apparatus for casting a cylinder block, for cast-molding a cylinder block having a cast-in cylinder liner by installing the cylinder liner inside a cavity and pouring a melt into the cavity, the mold apparatus comprising:

a first mold for defining a deck surface of the cylinder block; and a bore pin provided in the first mold so as to hold the cylinder liner inside the cavity when the mold is closed; wherein:

the bore pin holds the cylinder liner with a gap; and gas produced during the cast-molding is discharged via the gap."

(Mode 2)

"A mold apparatus for casting a cylinder block, for cast-molding a cylinder block having a cast-in cylinder liner by installing the cylinder liner inside a cavity and pouring a melt into the cavity, the mold apparatus comprising:

a first mold for defining a deck surface of the cylinder block;

a bore pin provided in the first mold so as to hold the cylinder liner inside the cavity when the mold is closed; and a gas discharge path for discharging the gas using the gap."

(Mode 3)

"The mold apparatus for casting a cylinder block according to mode 1 or 2, further comprising a water jacket-forming insert surrounding the cylinder liner held by the bore pin when the mold is closed; wherein:

the gas that has entered into a space inside the cavity is discharged via the gap, the space being formed by the cylinder liner held by the bore pin and by the water jacket-forming insert."

(Mode 4)

"The bore pin according to mode 3, wherein:

the bore pin has a shaft part with which the cylinder liner is fitted, and an enlarged-diameter part provided closer to the side of the first mold than to the shaft part and formed to a larger diameter than the shaft part; and the cylinder liner is held by the bore pin in a state in which longitudinal-direction movement of the cylinder liner is restricted by the enlarged-diameter part when the mold is closed, and the gas that has entered into a space inside the cavity is discharged via the gap, the space being formed by a longitudinal-direction end face of the cylinder liner, the enlarged-diameter part, and the water jacket-forming insert."

(Mode 5)

"The mold apparatus for casting a cylinder block according to mode 4, wherein the gap is formed between the longitudinal-direction end face of the cylinder liner and the enlarged-diameter part, and between an inner perimeter surface of the cylinder liner and an outer perimeter surface of the shaft part."

(Mode 6)

"The mold apparatus for casing a cylinder block according to any of modes 1 to 5, wherein the gap is configured to enable inflow of the gas but prohibit inflow of the melt."

(Mode 7)

"The mold apparatus for casing a cylinder block according to any of modes 1 to 6, wherein the bore pin has a recessed part formed on an outer perimeter surface, and a communicating path communicating between the recessed part and the outside of the mold apparatus for casting a cylinder block."

(Mode 8)

"The mold apparatus for casing a cylinder block according to mode 7, wherein the recessed part is configured as an annular groove continuing in a circumferential direction."

(Mode 9)

"The mold apparatus for casing a cylinder block according to mode 7 or 8, wherein the communicating path has a first hole opened in a direction from the recessed part toward the inside of the shaft part, and a second hole opened in a direction from the first hole toward the first mold."

(Mode 10)

"The mold apparatus for casing a cylinder block according to any of modes 2 to 6, wherein the gas discharge path has a recessed part formed on an outer perimeter surface of the bore pin, and a communicating path communicating between the recessed part and the outside of the mold apparatus for casting a cylinder block."

(Mode 11)

"The mold apparatus for casing a cylinder block according to mode 10, wherein the recessed part is configured as an annular groove continuing in a circumferential direction."

(Mode 12)

"The mold apparatus for casing a cylinder block according to mode 10 or 11, wherein the communicating path has a first hole opened in a direction from the recessed part toward the inside of the shaft part, and a second hole opened in a direction from the first hole toward the first mold."

(Mode 13)

"The mold apparatus for casing a cylinder block according to mode 9 or 12, wherein:

the recessed part has an axial groove connected to the annular groove and provided extending in a longitudinal-axis direction of the bore pin from the annular groove toward a leading end side of the bore pin; and the first hole is formed on a leading end side of the axial groove."

(Mode 14)

"The mold apparatus for casing a cylinder block according to any of modes 7 to 13, further comprising a vacuum suction device for rendering the inside of the cavity into a vacuum state; wherein:

the communicating path communicates between the recessed part and the vacuum suction device."

What is claimed is:

1. A mold apparatus for casting a cylinder block having a cast-in cylinder liner by installing the cylinder liner inside a cavity and pouring a melt into the cavity, the mold apparatus comprising:

a first mold configured to define a deck surface of the cylinder block;

a bore pin disposed in the first mold so as to hold the cylinder liner inside the cavity when the mold is closed; and a gas discharge portion configured to discharge gas generated while casting, the gas discharge portion being a gap between the bore pin and the cylinder liner.

2. The mold apparatus for casting a cylinder block according to claim 1, further comprising a water jacket-forming insert configured to surround the cylinder liner to be held by the bore pin when the mold is closed;

the gas discharge portion being arranged to enable gas that has entered into a space inside the cavity to be discharged therethrough, the space being formed by the cylinder liner held by the bore pin and by the water jacket-forming insert.

3. The mold apparatus for casting a cylinder block according to claim 2, wherein the bore pin has a shaft part with which the cylinder liner is to be fitted, and an enlarged-diameter part disposed closer to the first mold than to the shaft part and having a larger diameter than the shaft part, and the enlarged-diameter part is configured to restrict the longitudinal-direction movement of the cylinder liner when the mold is closed, and the gas discharge portion is configured to enable gas that has entered into a space inside the cavity to be discharged therethrough, the space being formed by a longitudinal-direction end face of the cylinder liner, the enlarged-diameter part, and the water jacket-forming insert.

4. The mold apparatus for casting a cylinder block according to claim 1, wherein the bore pin has a shaft part with which the cylinder liner is to be fitted, and an enlarged-diameter part disposed closer to the first mold than to the shaft part and having a larger diameter than the shaft part, and the enlarged-diameter part is configured to restrict the longitudinal-direction movement of the cylinder liner when the mold is closed, and the gas discharge portion is configured to enable gas that has entered into a space inside the cavity to be discharged therethrough, the space being formed by a longitudinal-direction end face of the cylinder liner, the enlarged-diameter part, and the water jacket-forming insert.

5. The mold apparatus for casting a cylinder block according to claim 4, wherein the bore pin has a recessed part on an outer perimeter surface, and a communicating path arranged to communicate between the recessed part and an outside of the mold apparatus for casting a cylinder block.

6. The mold apparatus for casting a cylinder block according to claim 5, wherein the recessed part is an annular groove extending in a circumferential direction.

7. The mold apparatus for casting a cylinder block according to claim 6, wherein the communicating path has a first hole opened in a direction from the recessed part toward an inside of the shaft part, and a second hole opened in a direction from the first hole toward the first mold.

8. The mold apparatus for casting a cylinder block according to claim 5, wherein the communicating path has a first hole opened in a direction from the recessed part toward an inside of the shaft part, and a second hole opened in a direction from the first hole toward the first mold.

9. The mold apparatus for casting a cylinder block according to claim 8, wherein the recessed part has an axial groove connected to the annular groove and extends in a longitudinal axis direction of the bore pin from the annular groove toward a leading end side of the bore pin and the first hole is on a leading end side of the axial groove.

10. The mold apparatus for casting a cylinder block according to claim 5, further comprising a vacuum suction device configured to bring the inside of the cavity into a vacuum state, the communicating path communicating between the recessed part and the vacuum suction device.

* * * * *